United States Patent [19]

Marshall et al.

[11] 4,290,757

[45] Sep. 22, 1981

[54] BURST ON TARGET SIMULATION DEVICE FOR TRAINING WITH ROCKETS

[75] Inventors: Albert H. Marshall, Orlando; Herbert C. Towle, Maitland, both of Fla.

[73] Assignee: The United States of America as represented by the Secretary of the Navy, Washington, D.C.

[21] Appl. No.: 157,750

[22] Filed: Jun. 9, 1980

[51] Int. Cl.[3] ..... F41G 3/26; F41J 5/02

[52] U.S. Cl. ..... 434/12; 434/20; 434/22

[58] Field of Search ..... 434/22, 12, 20; 273/312

[56] References Cited

U.S. PATENT DOCUMENTS

| | | | |
|---|---|---|---|
| 3,964,178 | 6/1976 | Marshall et al. | 434/22 X |
| 4,137,651 | 2/1979 | Pardes et al. | 434/22 X |
| 4,163,328 | 8/1979 | Sherburne et al. | 343/22 X |
| 4,170,077 | 10/1979 | Pardes | 434/22 |
| 4,177,580 | 12/1979 | Marshall et al. | 434/22 |
| 4,223,454 | 9/1980 | Mohon et al. | 434/22 X |
| 4,253,249 | 3/1981 | Ashford et al. | 434/22 |

*Primary Examiner*—William H. Grieb

*Attorney, Agent, or Firm*—Richard S. Sciascia; Robert W. Adams; David S. Kalmbaugh

[57] ABSTRACT

A weapons simulator for training a marksman on an anti-armor weapon. The weapons simulator includes first and second broadcasting means for projecting on a reflective display screen a background scene, a visual target, and an infrared target spot in alignment with the visual target, and a two-axis laser spot positioning servo system for moving the aligned visual target and infrared target spot upon the reflective display screen. A matrix detector mounted within the weapon will sense the position of the infrared target spot upon the reflective display screen whenever the marksman fires the weapon, and then supply to a microprocessor computer digital information indicative of the position of the infrared target spot upon the reflective display screen. The microprocessor computer, in turn, processes the digital information so as to determine whether the marksman has scored a hit, a miss, or near miss upon the visual target.

22 Claims, 4 Drawing Figures

BURST ON TARGET SIMULATION DEVICE FOR TRAINING WITH ROCKETS

BACKGROUND OF THE INVENTION

1. Field of the Invention

This invention relates generally to weapons simulators. in particular, this invention relates to a weapons simulator for training a marksman on an anti-armor weapon such as a Dragon Guidance System.

2. Description of the Prior Art

In order that military combat training may be carried out in a realistic manner without risk to the personnel taking part in the practice, there is need for a system which simulates the firing of a weapon, such as a Dragon Guidance System or other type of missile launcher. Especially, there is a need for a system to simulate combat with tanks and other armored vehicles. In order to make it possible to carry out combat field practice in a manner as realistic as possible, such a simulator system must be designed such that it does not prevent the target and the weapon with its operator from acting in a manner that would be natural and necessary in genuine combat. Further, the simulator must be designed to indicate immediately whether a simulated projectile fired by the weapon would have hit the intended target in the real case. In addition, the simulator system must give evidence of the skill and precision of the operator of the weapon.

One such device of the prior art utilizes a laser pulse of radiation which is emitted from a weapon in a direction dependent on the aiming direction of the weapon. The laser pulse of radiation, if it scores a hit upon the intended target, will actuate a radiation sensitive receiver device mounted on the target. However, prior art simulator systems of this type do not generally allow for realistic combat practice. In particular, these prior art systems do not consider the fact that real projectiles have a curved trajectory, and the fact that the propagation time for a laser pulse of radiation is negligible compared with the time of flight of a real projectile to a target. In addition, these prior art systems do not consider the fact that in genuine combat situations, the target is a moving target such that lead must be considered when firing the weapon.

SUMMARY OF THE INVENTION

The subject invention overcomes some of the disadvantages of the prior art, including those mentioned above, in that it comprises a relatively simple weapons simulator which may be utilized for training a marksman on an anti-armor weapon such as, for example, a Dragon Guidance System.

Included in the subject invention is a high resolution slide projector for projecting on a reflective display screen a background scene, a target projector for projecting on the reflective display screen a visual target, and an infrared target spot in alignment therewith, and a two-axis laser spot positioning servo system for moving the visual target and the infrared target spot in alignment therewith in a predetermined direction upon the reflective display screen.

A one hundred by one hundred matrix detector, mounted within the weapon, will sense the position of the infrared target spot upon the reflective display screen whenever the marksman fires the weapon, and then supply to a microprocessor computer through an interface board digital information indicative of the position of the infrared target spot upon the reflective display screen.

The microprocessor computer, in turn, processes the digital information provided by the one hundred by one hundred matrix detector so as to determine whether the marksman has scored a hit, a miss, or near miss upon the visual target.

In addition, whenever the marksman fires the weapon, the microprocessor computer activates a laser, which then projects upon the reflective display screen a laser burst pulse. The laser burst pulse, in turn, provides a visual indication of where the marksman has aimed the weapon.

DESCRIPTION OF THE PREFERRED EMBODIMENT

Figure 1:
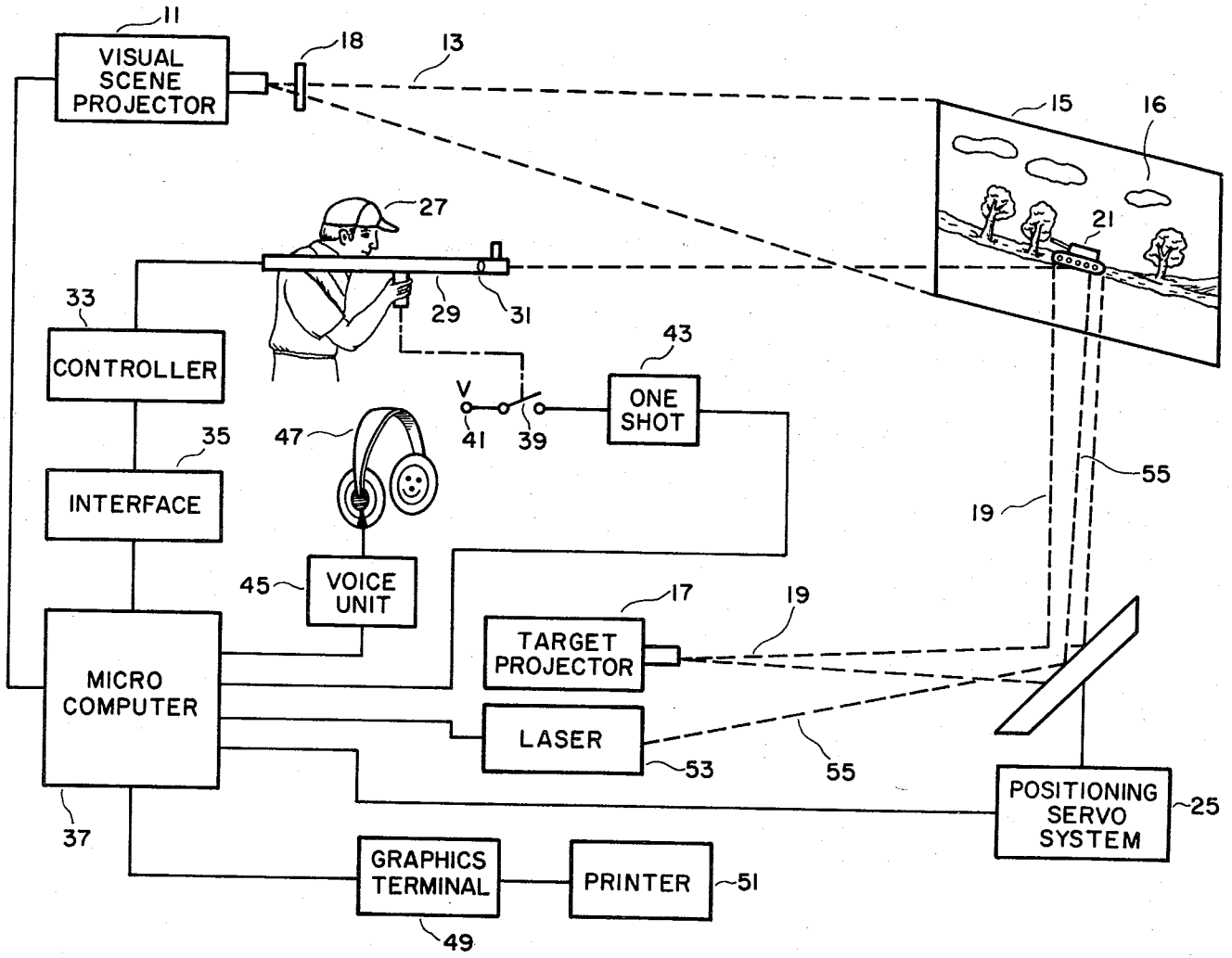
FIG. 1 is a schematic diagram of the preferred embodiment of the subject invention.

The preferred embodiment of the subject invention will now be discussed in some detail in conjunction with all of the figures of the drawing, wherein like parts are designated by like reference numerals.

Figure 2:
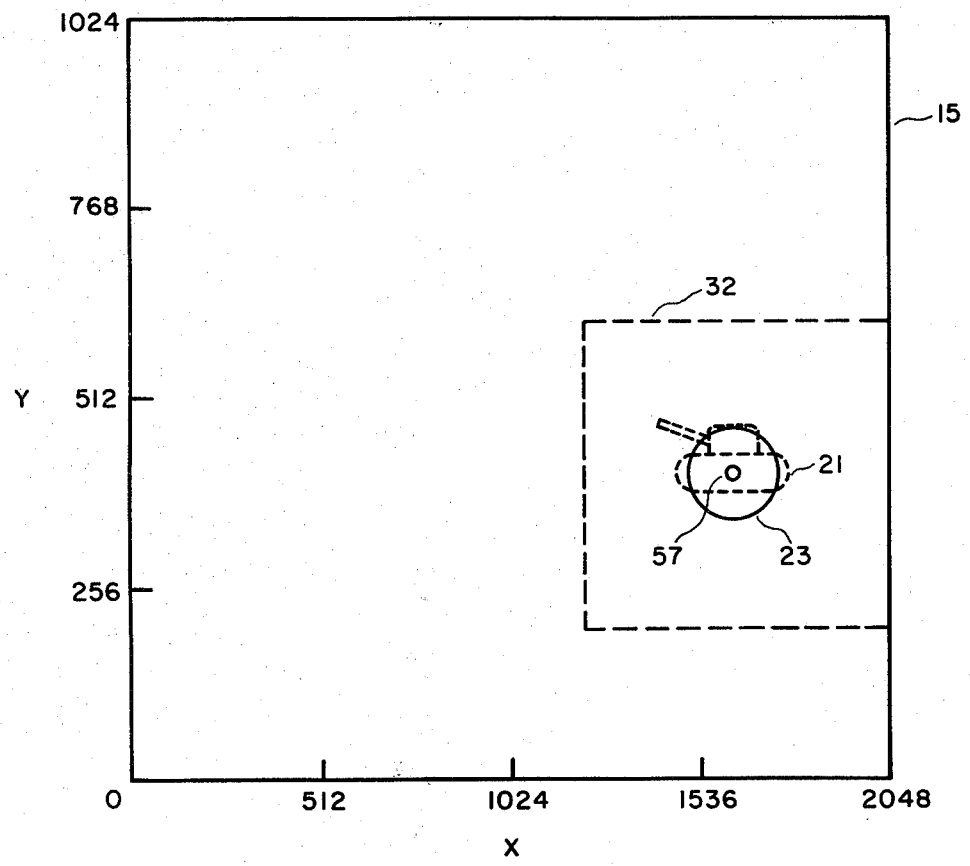
FIG. 2 is a diagram of an exemplary target scene.

Referring now to FIGS. 1 and 2, there is shown a high resolution visual scene slide projector 11 which projects visual information along an optical ligh path 13. Spatially disposed along optical light path 13 is a reflective display screen 15 which receives the aforementioned visual information so as to form a background scene 16 thereon. Positioned between high resolution projector 11 and reflective display screen 15 is an infrared filter 18.

A target projector 17 projects along a light path 19 target information which, when received by reflective display screen 15, forms thereon a visual target 21 and an infrared target spot 23, which is in alignment with visual target 21.

Spatially disposed downstream from target projector 17 along light path 19 is a two-axis laser spot positioning servo system 25 which functions, as will be discussed more fully below, to move both visual target 21 and infrared target spot 23 in a predetermined direction upon reflective display screen 15.

At this time it may be noted that any conventional and commercially available positioning means may be utilized as two-axis laser spot positioning servo system 25. In particular, it has been found that a two-axis laser spot positioning servo system, Model No. MPS 11-600, manufactured by BEI Electronics, Inc. of Little Rock, Ark., performs quite satisfactorily as two-axis spot positioning servo system 25.

Referring again in FIGS. 1 and 2, there is shown a marksman 27 schematically depicted as holding a fake or simulated weapon 29 which has thereon a trigger mechanism, not shown. Weapon 29, of course, may be of any type which simulates the anti-tank weapon on which marksman 27 is to be trained and may include, for example, a Dragon Guidance System, a mortar, a Law, a Viper, or a Tow Weapons System.

Mounted within weapon 29 near the front end thereof is a one hundred by one hundred matrix detector 31 which, as will be discussed more fully below, senses the position of infrared target spot 23 upon reflective display screen 15. Matrix detector 31 comprises an array of ten thousand photodiode sensing elements arranged in a one hundred by one hundred pattern. In addition, it may be noted that the field of view for matrix detector 31, which comprises the ten thousand photodiode sensing elements, is represented in FIG. 2 as a dashed line 32, and in FIGS. 3 and 4 as an X-Y coordinate system.

The input-output terminal of one hundred by one hundred matrix detector 31 is connected to the input-output terminal of a controller 33, which continuously scans field of view 32 of matrix detector 31 for infrared target spot 23 on a line by line basis in a horizontal direction. The data output of controller 33 is connected to the data input of an interface board 35, with the input-output terminal thereof connected to the input-output terminal of a microprocessor computer 37.

At this time it may be noteworthy to mention that detector 31 may be a Model No. MC520 camera, controller 33 may be a Model No. RS520 controller, and interface board 35 may be a Model No. RSB 6020 camera interface, all of which are manufactured by Reticon, Inc., of Sunnyvale, Calif. In addition, it may be noted that microprocessor computer 37 may be a microprocessor computer Model No. SBC 86/12, manufactured by Intel, Inc., of Santa Clara, Calif.

The trigger mechanism of weapon 29 is mechanically connected to a normally open switch 39, the input of which is connected to the output of a direct current voltage source 41. The output of switch 39 is, in turn, connected to the input of a one-shot multivibrator 43, with the output thereof connected to the trigger input of microprocessor computer 37.

The first output of microprocessor computer 37 is connected to the input of two-axis laser spot positioning servo system 25, the second output of microprocessor computer 37 is connected to visual scene slide projector 11, and the third output of microprocessor computer 37 is connected to a voice unit 45. The output of voice unit 45 is, in turn, connected to a headphone 47, which is adapted to be worn upon the head of marksman 27.

It may be noteworthy to mention that voice unit 45 may be any conventional computer voice system and is commercially available from several different sources. In particular, it has been found that a computer voice system Model LVM 70, manufactured by Votrax of Troy, Mich., performs quite satisfactorily as voice unit 45.

The fourth output of microprocessor computer 37 is connected to the input of graphics terminal 49, the output of which is connected to the input of printer 51. The fifth output of microprocessor computer 37 is connected to the input of a laser 53 which, as will be discussed more fully below, projects along an optical light path 55 a laser burst pulse.

The operation of the subject invention will now be discussed in conjunction with all of the figures of the drawing.

Referring first to FIGS. 1 and 2, there is shown high resolution visual scene slide projector 11 which projects upon reflective display screen 15 background scene 16. Filter 18 deletes from the visual information broadcast along light path 13 any spurious infrared energy such that the aforementioned background scene will have any infrared energy removed therefrom.

Simultaneously with the projection of background scene 16 upon reflective display screen 15, target projector 17 projects upon reflective display screen 15 visual target 21 which includes, as discussed previously, infrared target spot 23 in alignment therewith. Visual target 21, of course, may be a tank or other type of armored personnel carrier that it is desired for marksman 27 to train with.

Movement of visual target 21 and the infrared target spot 23 in alignment upon reflective display screen 15 is, as mentioned above, controlled by two-axis laser spot positioning servo system 25. A position control signal provided by microprocessor computer 37 activates positioning servo system 25 such that the target information broadcast along optical light path 19 will be reorientated in a predetermined manner so as to move visual target 21 and the infrared target spot 23 in alignment therewith in a predetermined direction upon reflective display screen 15. As will be discussed more fully below, the movement of the aligned visual target 21 and infrared target spot 23 on reflective display screen 15 is based upon a predetermined coordinate system with the exact position and velocity of target 21 and infrared target spot 23, at any given instant of time, being stored in the memory of microprocessor computer 37. The coordinate system utilized in the subject invention is a 1024 by 2048 system, although it should be recognized by the artisan that other coordinate systems will function satisfactorily within the subject invention. In addition, in the example illustrated in FIG. 2, the center point of target 21 and the infrared target spot 23 in alignment therewith is shown at a location 57 having an X coordinate of approximately 1638 and a Y coordinate of approximately 410.

Referring now to FIGS. 1 and 2, there is shown marksman 27 holding weapon 29 which the aforementioned marksman is aiming at visual target 21. Whenever marksman 27 activates the trigger mechanism of weapon 29, switch 39 will be in the closed position, thus causing direct current provided by voltage source 41 to be supplied to the input of one-shot multivibrator 43. This, in turn, triggers one-shot multivibrator 43, which supplies to the input of microprocessor computer 37 a trigger pulse of predetermined duration so as to indicate to microprocessor computer 37 that marksman 27 has fired weapon 29 at visual target 21.

As mentioned above, matrix detector 31 continuously senses reflective display screen 15 for infrared target spot 23. Controller 33, in turn, scans field of view 32 of matrix detector 31 on a line by line basis in the horizontal direction, and then provides at the output thereof digital data bits or information indicative of the position of infrared target spot 23. In addition, it may be noteworthy to mention that each photodiode sensing element of matrix photodetector 31 provides at the output thereof an analog signal which indicates either the presence or absence of infrared target spot 23. The analog signal from each photodiode sensing element of field of view 32 of matrix detector 31 is then converted to one of the aforementioned digital data bits by controller 33.

When microprocessor computer 37 receives a trigger pulse from one-shot multivibrator 43, microprocessor computer 37 will supply to interface circuit 35 a start pulse. This, in turn, initiates interface circuit 35 which upon completion of the scan of the lowest positioned horizontal line of field of view 32 by controller 33, will begin to extract from controller 33 the digital information provided thereby.

Figure 3:
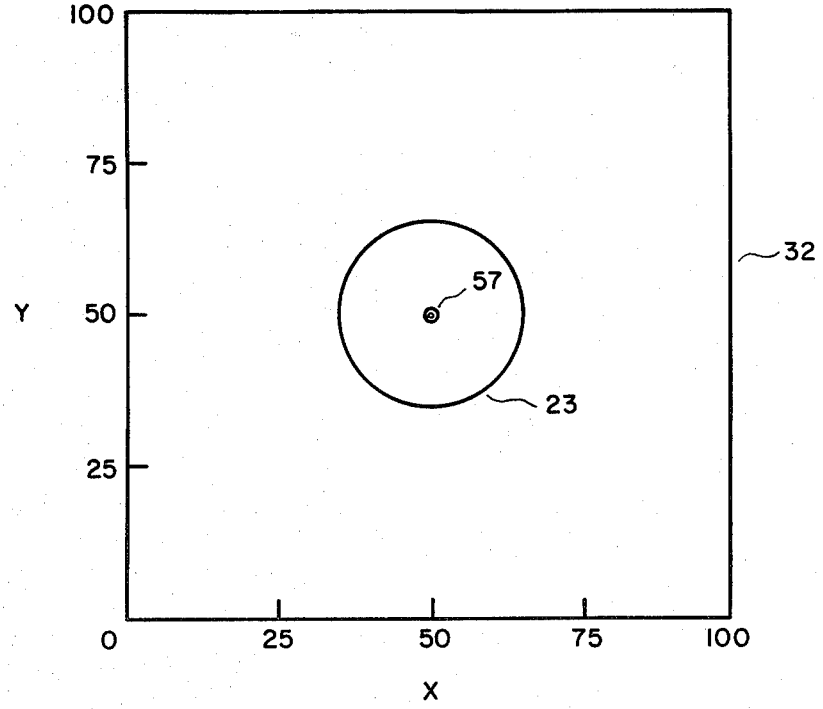
FIG. 3 is an enlarged view of the infrared target spot of the target scene of FIG. 2, wherein the visual target is stationary.

Referring now to FIGS. 1, 2, and 3, it may be assumed for the purpose of illustration that visual target 21 is stationary and that an imaginary projectile fired by weapon 29 will have a straight line trajectory. Thus, marksman 27, to score a hit upon visual target 21, must aim weapon 29 at center point 57 of visual target 21.

Interface circuit 35, as mentioned above, upon completion of the scan of lowest positioned horizontal line of field of view 32 by controller 33, will begin to extract from controller 33 the digital data information provided thereby. This, in turn, allows microprocessor computer 37, in accordance with a target position determination program, to calculate center point 57 of infrared target spot 23, utilizing the formulas:

$$X_c=(X_1+X_2)/2 \quad (1)$$

where $X_c$ is the X coordinate of center point 57 of infrared target spot 23, $X_1$ is the maximum value of an X coordinate of infrared target spot 23, and $X_2$ is the minimum value of an X coordinate of infrared target spot 23, and $$Y_c=(Y_1+Y_2)/2 \quad (2)$$

where $Y_c$ is the Y coordinate of center point 57 of infrared target spot 23, $Y_1$ is the maximum value of a Y coordinate of infrared target spot 23, and $Y_2$ is the minimum value of a Y coordinate of infrared target spot 23.

Controller 33 will scan each horizontal line of field of view 32 of matrix detector 31, beginning with the highest positioned line, until a photodiode within field of view 32 of matrix detector 31 senses infrared target spot 23. For the example illustrated in FIGS. 2 and 3, a photodiode within field of view 32 of matrix detector 31 will first sense infrared target spot 23 at an X coordinate of fifty and a Y coordinate of sixty-five within field of view 32. Controller 33, in response to an analog signal provided by matrix detector 31, supplies to microprocessor computer 37 through interface circuit 35, digital data information indicative of the aforementioned Y coordinate which is then stored in the memory of microprocessor computer 37 as $Y_1$ of formula (2) above.

At this time it may be noteworthy to mention that interface circuit 35 includes first and second onboard random access memories, not shown. This, in turn, allows digital data information provided by one horizontal line scan of field of view 32 to be stored in one of the two random access memories of interface circuit 35, while digital information from the previous horizontal line scan, which was stored in the other random access memory of interface circuit 35, is supplied to microprocessor computer 37 for processing thereby. Thus, the digital information extracted from controller 33 by interface circuit 35 will be supplied to microprocessor computer 37 without interruption at an extremely fast transfer rate of approximately ten kilohertz per horizontal line of field of view 32.

Controller 33 ill next scan the sixty-fourth horizontal line of field of view 32 of matrix detector 31 so as to determine the X coordinates of infrared target spot 23 with respect to the aforementioned sixty-fourth horizontal line. Upon scanning the sixty-fourth horizontal line of field of view 32 of matrix detector 31, controller 33 will first detect infrared target spot 23 at an X coordinate of forty-nine, and again detect infrared target spot 23 at an X coordinate of fifty-one, with the aforementioned X coordinate values of forty-nine and fifty-one being strored in the memory of computer 37 as $X_1$ and $X_2$ of formula (1) above. In addition, sixty-four will be stored in the memory of computer 37 as $Y_2$ of formula (2) above.

Controller 33 will continue to scan the horizontal lines of field of view 32 of matrix detector 31 so as to determine the X coordinates of infrared target spot 23 with respect to each horizontal line. The value of the X coordinates of infrared target spot 23 for each successive scanned horizontal line of field of view 32 is then stored in the memory of microprocessor computer 37 as $X_1$ and $X_2$ of formula (1). Similarly, the horizontal line number of the horizontal line of field of view 32 scanned by controller 33 is stored in the memory of computer 37 as $Y_2$ in formula (2).

When controller 33 scans the fiftieth horizontal line of field of view 32 so as to determine the X coordinates of infrared target spot 23 with respect to the aforementioned fiftieth horizontal line, microprocessor computer 37 will store in the memory thereof an $X_2$ of thirty-five, an $X_1$ of sixty-five, and a $Y_2$ of fifty.

Upon completion of the scan of the forty-ninth horizontal line of field of view 32 by controller 33, microprocessor computer 37, in accordance with the target position determination program utilized thereby, will store in the memory thereof only a $Y_2$ of forty-nine since, in accordance with the aforementioned program, the coordinates of $X_1$ and $X_2$ of formula (1) and $Y_1$ of formula (2) have been determined by microprocessor computer 37. Microprocessor computer 37 will continue to store in the memory thereof the number of the horizontal line of field of view 32 scanned by controller 33 until matrix detector 31 no longer senses infrared target spot 23. Microprocessor computer 37 will then utilize the number of the last horizontal line of field of view 32 upon which infrared target spot 23 was sensed as $Y_2$. This, in turn, allows for the calculation by computer 37, in accordance with formulas (1) and (2) above, of center point 57 of infrared target spot 23. For the example being discussed, $Y_2$ is thirty-five and center point 57 of infrared target spot 23 has a $Y_c$ of fifty and $X_c$ of fifty.

Microprocessor computer 37 will then determine the accuracy of the aim of marksman 27 at visual target 21, in accordance with the target position determination program utilized thereby. An $X_c$ of fifty and a $Y_c$ of fifty, for the example discussed above, indicates that marksman 27 has scored a direct hit upon visual target 21. Similarly, an $X_c$ of eighty and $Y_c$ of eighty would indicate that marksman 27 has aimed weapon 29 low and to the left of visual target 21.

Microprocessor computer 37 then supplies to the input of voice unit 45 indicator signals indicative of whether marksman 27 has scored a hit, a miss, or a near miss upon visual target 21. Voice unit 45, in turn, provides marksman 27 with a prerecorded message through headphones 47 indicative of whether marksman 27 has scored a hit, a miss, or a near miss upon visual target 21.

A laser burst signal provided by microprocessor computer 37, whenever marksman 27 fires weapon 29, activates laser 53 such that laser 53 will project upon reflective display screen 15 a laser burst pulse which indicates to marksman 27 where he has aimed weapon 29. Simultaneously, microprocessor computer 37 supplies to two-axis laser spot positioning servo system 25 a burst control signal so as to orientate positioning servo system 25 such that the laser burst pulse broadcast along optical light path 55 will hit reflective display screen 15 where marksman 27 aimed weapon 29.

The indicator signals provided by microprocessor computer 37 are supplied to the inputs of graphics terminal 49 and printer 51. Graphics terminal 49, in turn, provides a visual display of the accuracy of marksman 27 when aiming weapon 29 at visual target 21. In addition, printer 51 provides a printed record of marksman's 27 score which allows for later review by marksman 27 such that any specific fault which appears to be repeated may be corrected by marksman 27.

Figure 4:
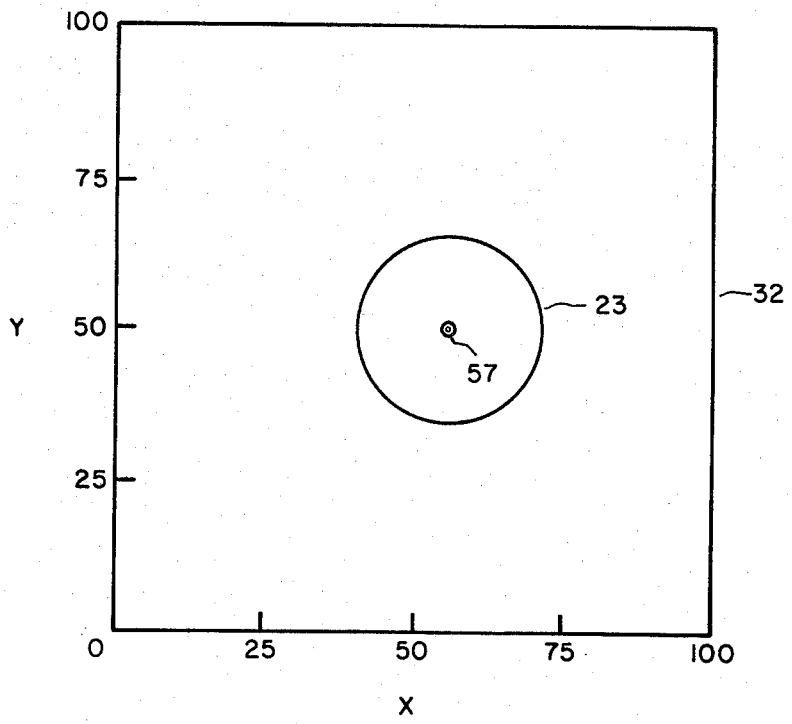
FIG. 4 is an enlarged view of the infrared target spot of the target scene of FIG. 2, wherein the visual target is moving at a predetermined velocity.

Referring now to FIGS. 1 and 4, it may be assumed, for the purpose of illustration, that visual target 21 and infrared target spot 23 in alignment therewith, are moving in a predetermined path from right to left upon reflective display screen 15, and that an imaginary projectile fired by weapon 29 will have a straight line of trajectory. Thus, marksman 27, to score a hit upon visual target 21, must aim weapon 29 in accordance with the following formula:

$$X_A = X_F + \Delta X \quad (3)$$

where $X_A$ is the X coordinate of center point 57 of infrared target spot 23 upon field of view 32 where marksman 27 should aim weapon 29 to score a hit upon visual target 21, $X_F$ is the X coordinate of the center of field of view 32, and $\Delta X$ is a programmed numerical value stored in the memory of microprocessor computer 37 which accounts for the movement of visual target 21 upon reflective display screen 15. It may be mentioned at this time that $\Delta X$ of formula (3), above, can be either a function of velocity or acceleration depending upon the program utilized within microprocessor computer 37.

As mentioned above, for the purpose of illustration, it may be assumed that visual target 21 and infrared target spot 23 in alignment therewith are moving from right to left upon reflective display screen 15 at a velocity having a $\Delta X$ of five. Thus, to score a hit upon visual target 21, marksman 27 must aim weapon 29 such that center point 57 of infrared target spot 23 has an X coordinate of fifty-five in accordance with formula (3) above and a Y coordinate of fifty as illustrated in FIG. 4.

It may be desired when training marksman 27 to simulate an anti-armor weapon which requires that the trajectory of an imaginary projectile launched thereby be considered when firing the aforementioned weapon. This, in turn, would require that marksman 27 consider elevation when aiming weapon 29 at visual target 21 in accordance with the following formula:

$$Y_A = Y_F + \Delta Y \quad (4)$$

where $Y_A$ is the Y coordinate of center point 57 of infrared target spot 23 upon field of view 32 where marksman 27 should aim weapon 29, $Y_F$ is the Y coordinate of the center of field of view 32, and $\Delta Y$ is a programmed numerical value stored in the memory of microprocessor computer 37 which accounts for the trajectory of an imaginary projectile launched by weapon 29.

From the foregoing, it may readily be seen that the subject invention comprises a new, unique, and exceedingly useful weapons simulator for training a marksman on an anti-armor weapon which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. A burst on target simulator device for training with rockets, comprising in combination:

first broadcasting means having an input for projecting visual information along a first light path;

second broadcasting means for projecting target information along a second light path, said target information including a visual target and an infrared target spot in alignment with said visual target;

a reflective display screen spatially disposed downstream from said first broadcasting means adapted for receiving the visual information projected along said first light path so as to form thereon a background scene, and the target information projected along said second light path so as to form thereon said visual target and said infrared target spot in alignment therewith;

positioning means located between said second broadcasting means and said reflective display screen, and having an input for redirecting the target information projected along said second light path in a predetermined manner so as to move said visual target and the infrared target spot in alignment therewith in a predetermined direction upon said reflective display screen;

a weapon having a trigger mechanism for effecting the simulated firing thereof;

sensing means mounted within said weapon and having a data output for continuously sensing the position of said infrared target spot upon said reflective display screen, and for continuously providing at the output thereof digital data bits indicative of the position of said infrared target spot upon said reflective display screen; and computing means having a data input connected to the data output of said sensing means, trigger input connected to the output of the trigger mechanism of said weapon, a first output connected to the input of said positioning means, a second output connected to the input of said first broadcasting means, a third output, a fourth output, and a fifth output for extracting from said sensing means the digital data bits provided thereby only when a marksman activates the trigger mechanism of said weapon, for processing the digital data bits extracted from said sensing means so as to determine the extract position of said infrared target spot only when said marksman activates the trigger mechanism of said weapon, for providing indicator signals indicative of whether said marksman has scored a hit, miss, or near miss upon said visual target, and for providing a position control signal so as to activate said positioning means and thereby control the movement of said visual target, and the infrared target spot in alignment therewith upon said reflective display screen.

2. The burst on target simulator device according to claim 1, wherein said first broadcasting means comprises a high resolution visual scene slide projector.

3. The burst on target simulator device according to claim 1, wherein said positioning means comprises a two-axis laser spot positioning servo system.

4. The burst on target simulator device according to claim 1, wherein said weapon comprises a Dragon Guidance System.

5. The burst on target simulator device according to claim 1, wherein said weapon comprises a mortar.

6. The burst on target simulator device according to claim 1, wherein said sensing means comprises:

a one hundred by one hundred matrix photodetector array mounted within said weapon and having an input-output terminal; and a controller having an input-output terminal connected to the input-output terminal of said one hundred by one hundred matrix photodetector array.

7. The burst on target simulator device according to claim 1, wherein said computing means comprises:

an interface circuit having a data input connected to the data output of said sensing means, and an input-output terminal; and a microprocessor computer having an input-output terminal connected to the input-output terminal of said interface circuit, and a trigger input connected to the output of the trigger mechanism of said weapon.

8. The burst on target simulator device according to claim 1, further characterized by means spatially disposed downstream from said first broadcasting means for filtering infrared noise from the visual information projected along said first optical path.

9. The burst on target simulator device according to claim 1, further characterized by means having an input connected to the third output of said computing means for supplying to said marksman a plurality of prerecorded messages, each of which is in response to one of the indicator signals provided by said computing means, and each of which is indicative of a hit, a miss, or a specific area of near miss scored upon said visual target by said marksman.

10. The burst on target simulator device according to claim 9, wherein said means for supplying to said marksman said plurality of prerecorded messages comprises:

a voice unit having an input connected to the third output of said computing means and an output; and a headphone having an input connected to the output of said voice unit.

11. The burst on target simulator according to claim 1, further characterized by:

a graphics terminal having an input connected to the fourth output of said computing means and an output; and a printer having an input connected to the output of said graphics terminal.

12. The burst on target simulator device according to claim 1, further characterized by a laser having an input connected to the fifth output of said computing means adapted for projecting upon said reflective display screen a laser burst pulse whenever said marksman activates the trigger mechanism of said weapon, said laser burst pulse indicating where said marksman has aimed said weapon.

13. An apparatus for simulating the firing of a weapon at an armored target comprising in combination:

a reflective display screen;

a visual scene slide projector spatially disposed from said reflective display screen in such a manner so as to project thereon a background scene, said visual scene slide projector having an input;

a target projector spatially disposed from said reflective display screen in such a manner so as to project thereon a visual target and an infrared target spot in alignment therewith;

a two-axis laser spot positioning servo system positioned between said target projector and said reflective display screen in such a manner so as to provide for the movement, in a predetermined direction, of said visual target and the infrared target spot in alignment therewith upon said reflective display screen;

an imitation weapon having a trigger mechanism for effecting the simulated firing thereof;

a normally open switch connected to the trigger mechanism of said weapon, said normally open switch having an input and an output for providing a trigger pulse whenever the trigger mechanism of said weapon is activated by a marksman;

a matrix detector mounted within said weapon, and having an input-output terminal for continuously sensing the position of said infrared target upon said reflective display screen, and for continuously providing at the input-output terminal thereof analog signals indicative of the position of said infrared target spot on said reflective display screen;

a controller having an input-output terminal connected to the input-output terminal of said matrix detector, and a data output for converting the analog signals provided by said controller to digital data bits indicative of the position of said infrared target spot upon said reflective display screen;

an interface circuit having a data input connected to the data output of said controller and an input-output terminal for extracting from said matrix detector the digital data bits provided thereby only when said marksman activates the trigger mechanism of said weapon;

a microprocessor computer having a trigger input effectively connected to the output of said switch, an input-output terminal connected to the input-output terminal of said interface circuit, a first output connected to the input of said two-axis laser spot positioning servo system, a second output connected to the input of said visual scene slide projector, a third output, a fourth output, and a fifth output adapted for supplying to said interface circuit a start pulse in response to the trigger pulse provided by said switch so as to effect the extraction of the digital data bits from said controller by said interface circuit, for processing the digital data bits extracted from said controller by said interface circuit so as to determine the exact position of said infrared target spot only when said marksman activates the trigger mechanism of said weapon, for providing indicator signals indicative of whether said marksman has scored a hit, miss, or near miss upon said visual target, and for providing a position control signal so as to activate said two-axis laser spot positioning servo system and thereby control the movement of said visual target and the infrared target spot in alignment therewith upon said reflective display screen; and a laser having an input connected to the fifth output of said microprocessor computer adapted for projecting upon said reflective display screen a laser burst pulse whenever said marksman activates the trigger mechanism of said weapon, said laser burst pulse indicating where said marksman has aimed said weapon.

14. The apparatus of claim 13, wherein said matrix detector comprises an array of photodiodes arranged in a one hundred by one hundred pattern.

15. The apparatus of claim 13, wherein said imitation weapon comprises a mortar.

16. The apparatus of claim 13, wherein said imitation weapon comprises a Dragon Guidance System.

17. The apparatus of claim 13, further characterized by a filter positioned between said visual scene slide projector and said reflective display screen for deleting from the background scene projected upon said reflective display screen, spurious radiant energy.

18. The apparatus of claim 13, further characterized by a direct current voltage source having an output connected to the input of said normally open switch.

19. The apparatus of claim 13, further characterized by a one-shot multivibrator connected between the output of said switch and the trigger input of said microprocessor computer.

20. The apparatus of claim 13, further characterized by means having an input connected to the third output of said microprocessor computer for supplying to said marksman a plurality of prerecorded messages, each of which is in response to one of the indicator signals provided by said microprocessor computer, and each of which is indicative of a hit, a miss, or a specific area of near miss scored upon said visual target by said marksman.

21. The apparatus of claim 20, wherein said means for supplying to said marksman said plurality of prerecorded messages comprises:

a voice unit having an input connected to the third output of said microprocessor computer and an output; and a headphone having an input connected to the output of said voice unit.

22. The apparatus of claim 13, further characterized by:

a graphics terminal having an input connected to the fourth output of said microprocessor computer and an output; and a printer having an input connected to the output of said graphics terminal.

* * * * *